US005161435A

United States Patent [19]

Brannon

[11] Patent Number: 5,161,435

[45] Date of Patent: Nov. 10, 1992

[54] CONTAINER SEAL REMOVAL APPARATUS

[76] Inventor: Jean E. Brannon, 85 Central Ave., Garden City Park, N.Y. 11040

[21] Appl. No.: 858,231

[22] Filed: Mar. 26, 1992

[51] Int. Cl.[5] ..... B67B 7/00

[52] U.S. Cl. ..... 81/3.09; 81/3.44; 81/3.47

[58] Field of Search ..... 81/3.05, 3.07, 3.09, 81/3.4, 3.41, 3.44, 3.55, 3.47, 3.56, 3.48, 3.49; 294/33, 99.2

[56] References Cited

U.S. PATENT DOCUMENTS

| | | | |
|---|---|---|---|
| 317,318 | 5/1885 | Davis | 81/3.05 X |
| 1,605,811 | 11/1926 | Danielson | 81/3.09 X |
| 2,651,226 | 9/1953 | Hopmann | 81/3.09 |
| 3,521,923 | 7/1970 | Noel | 294/99.2 X |
| 4,226,459 | 10/1980 | Natalicio | 294/99.2 |
| 2,7839,325 | 6/1958 | Jeanfavre | 294/99.2 |

*Primary Examiner*—D. S. Meislin
*Attorney, Agent, or Firm*—Leon Gilden

[57] ABSTRACT

A plurality of spring-biased legs mounted relative to one another defining an acute angle therebetween include respective prying and piercing legs pivotally mounted at a common junction relative to the first and second legs. The first and second legs include semi-cylindrical heads arranged whose axes are parallel relative to one another, and each including an abutment flange to engage a container seal subsequent to its piercing and prying relative to a neck portion of a container.

4 Claims, 4 Drawing Sheets

CONTAINER SEAL REMOVAL APPARATUS

BACKGROUND OF THE INVENTION

1. Field of the Invention

The field of invention relates to container apparatus, and more particularly pertains to a new and improved container seal removal apparatus wherein the same is directed to the piercing and removal of a container seal.

2. Description of the Prior Art

Container seals of various types are utilized in the prior art to effect protection and afford freshness relative to contents of an associated container. Such seals are typically of a thickness to discourage individuals from their removal without an accessory tool. The removal of the seal structure requires its being pierced and pried and/or partially severed to permit its removal, wherein the instant invention sets forth the use of tong-like members to effect grasping of the seal prior to its severing relative to the container. Prior art container structure is addressed in the U.S. Pat. Nos. 4,702,130 to Davis; 4,762,029 to Chen; and 4,235,132 to Kendall relative to cap removal structure.

Accordingly, it may be appreciated that there continues to be a need for a new and improved container seal removal apparatus as set forth by the instant invention which addresses both the problems of ease of use as well as effectiveness in construction in the removal of closure seals of container members and in this respect, the present invention substantially fulfills this need.

SUMMARY OF THE INVENTION

In view of the foregoing disadvantages inherent in the known types of container closure removal apparatus now present in the prior art, the present invention provides a container seal removal apparatus wherein the same is arranged to effect the piercing, prying, and subsequent removal of a seal member relative to a container. As such, the general purpose of the present invention, which will be described subsequently in greater detail, is to provide a new and improved container seal removal apparatus which has all the advantages of the prior art container closure removal apparatus and none of the disadvantages.

To attain this, the present invention provides a plurality of spring-biased legs mounted relative to one another defining an acute angle therebetween including respective prying and piercing legs pivotally mounted at a common junction relative to the first and second legs. The first and second legs include semi-cylindrical heads arranged whose axes are parallel relative to one another, and each including an abutment flange to engage a container seal subsequent to its piercing and prying relative to a neck portion of a container.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this discloser is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved container seal removal apparatus which has all the advantages of the prior art container closure removal apparatus and none of the disadvantages.

It is another object of the present invention to provide a new and improved container seal removal apparatus which may be easily and efficiently manufactured and marketed.

It is a further object of the present invention to provide a new and improved container seal removal apparatus which is of a durable and reliable construction.

An even further object of the present invention is to provide a new and improved container seal removal apparatus which is susceptible of a low cost of manufacture with regard to both materials and labor, and which accordingly is then susceptible of low prices of sale to the consuming public, thereby making such container seal removal apparatus economically available to the buying public.

Still yet another object of the present invention is to provide a new and improved container seal removal apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
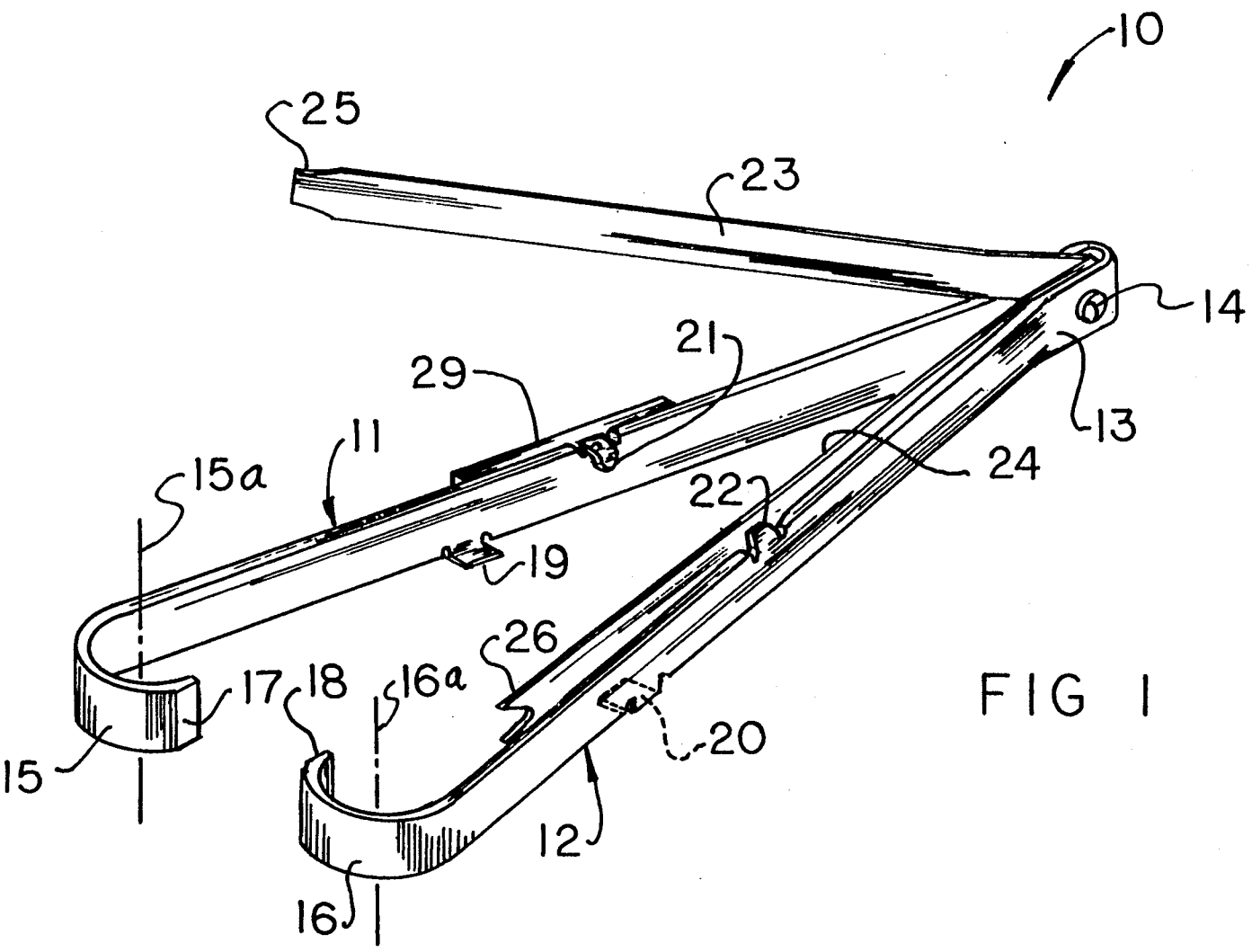
FIG. 1 is an isometric illustration of the instant invention.

With reference now to the drawings, and in particular to FIGS. 1 to 7 thereof, a new and improved container seal removal apparatus embodying the principles and concepts of the present invention and generally designated by the reference numeral 10 will be described.

Figure 2:
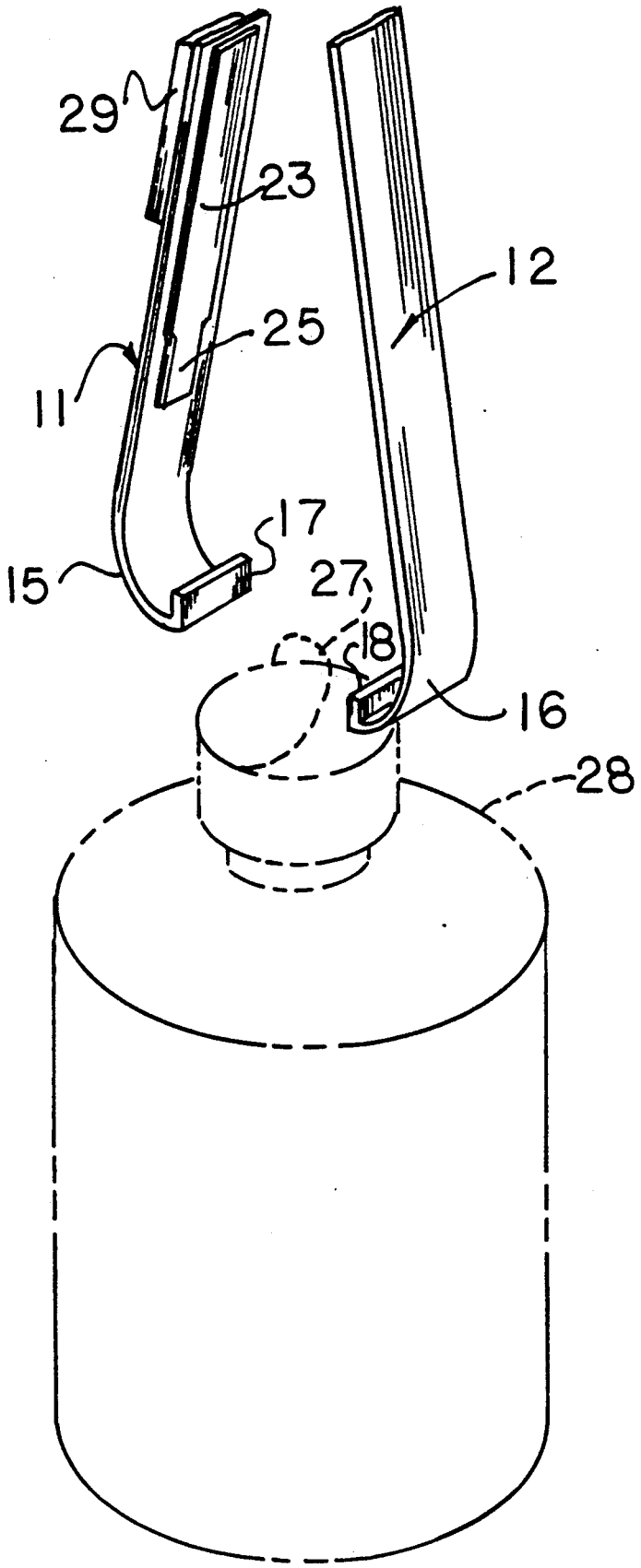
FIG. 2 is an isometric illustration of the invention arranged for the grasping of a seal member subsequent to its being severed relative to a container member.
Figure 3:
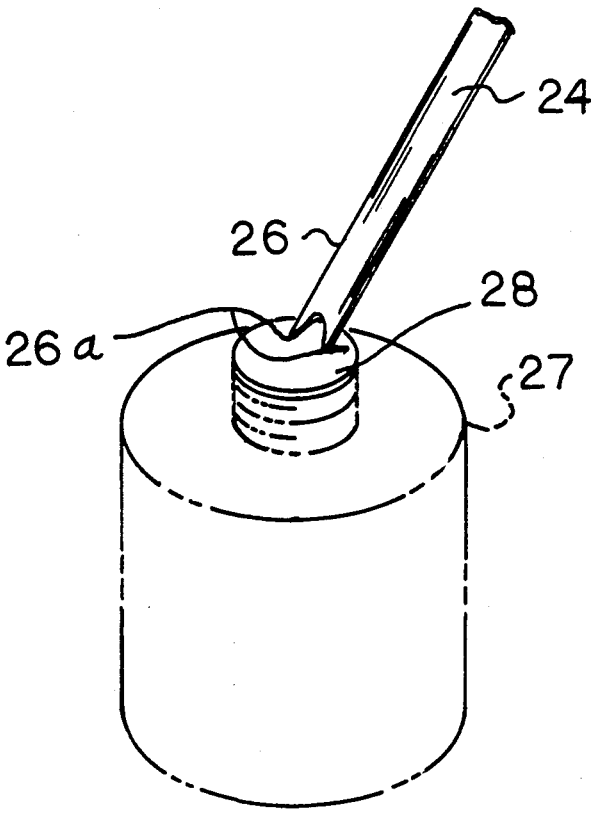
FIG. 3 is an isometric illustration of the piercing leg arranged for the piercing and subsequent severing of a container seal.
Figure 4:
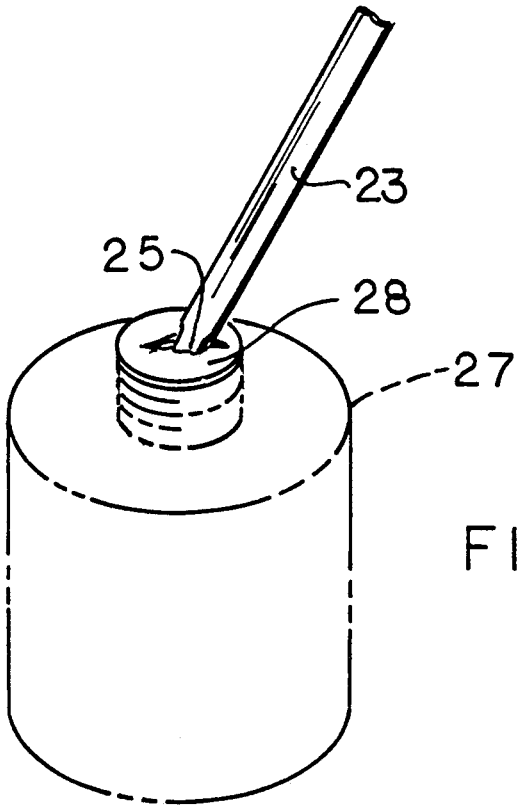
FIG. 4 illustrates the use of a container seal in association with a prying leg of the instant invention.
Figure 7:
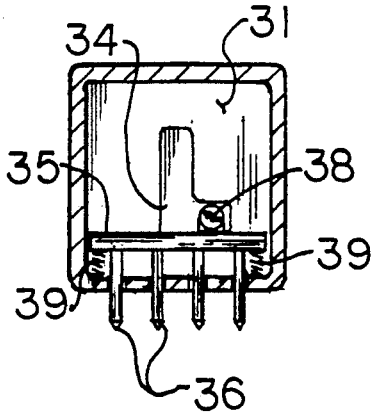
FIG. 7 is an orthographic view, taken along the lines 7—7 of FIG. 6 in the direction indicated by the arrows.

More specifically, the container seal removal apparatus 10 of the invention essentially comprises a first leg plate 11 mounted to a second leg plate 12 at a junction 13, with the first and second leg plates defining an acute angle therebetween and arranged in a spring-biased spaced relationship relative to one another. A tubular axle 14 is orthogonally directed through the junction to permit securement of the apparatus about a hook, key chain, and the like for ease of storage thereof. A magnetic mounting member 29 is mounted to an exterior surface of the first leg plate 11 to permit securement of the organization relative to a ferrous support surface (not shown). The first leg plate includes a first semi-cylindrical head 15 defined about a first axis 15*a*, with the second leg plate 12 including a second leg plate semi-cylindrical head 16 defined about a second axis 16*a* oriented parallel to the first axis 15*a*. The first head 15 includes a first head abutment flange 17 arranged in a spaced confronting relationship relative to a second head abutment flange 18, with the first and second flanges 17 and 18 tangentially aligned relative to the respective first and second semi-cylindrical heads 15 and 16 to permit the grasping and securement of a container foil seal 27 therebetween, in a manner as illustrated in FIG. 2.

A first leg positioning flange 19 is orthogonally mounted to a forward side edge of the first leg plate 11, with a second leg positioning flange 20 orthogonally mounted to a forward side edge of the second leg plate 12, with the first and second flanges 19 and 20 projecting towards one another in a parallel relationship to provide an abutment surface for a respective prying leg 23 and a piercing leg 24 that are pivotally mounted in adjacency relative to the respective first and second leg plates 11 and 12 through the axle 14. A first resilient projection 21 is orthogonally mounted to a rear side edge of the first leg plate 11, with a second resilient projection 22 mounted orthogonally to a rear side edge of the second leg plate 12 to permit capturing in a selective manner the prying leg 23 and the piercing leg 24 between the respective flanges and projections mounted to the respective first and second legs, in a manner as illustrated in FIG. 1. The prying leg 23 includes a forward pry blade 25 coplanar with the prying leg 23 to permit prying of a foil seal 27 relative to a container 28, wherein the piercing leg 24 includes a U-shaped bifurcated piercing head 26 including a plurality of spikes 26*a* defining a recess therebetween formed with a continuous cutting edge between the spikes to permit the severing of a foil seal for ease of removal of the foil seal relative to a container 28.

Figure 5:
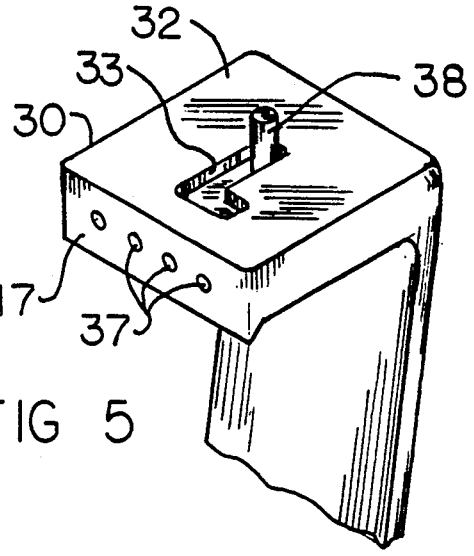
FIG. 5 is an isometric illustration of a modified arcuate head utilized by the invention.
Figure 6:
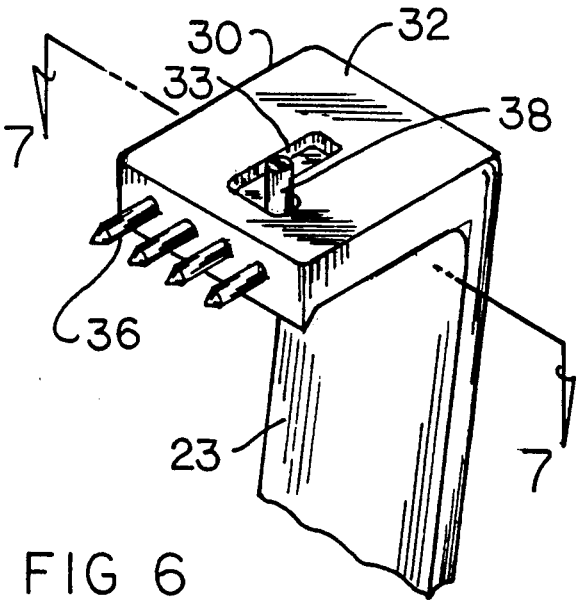
FIG. 6 is an isometric illustration of the modified head illustrating the engaging pins projecting forwardly thereof.

A modified first semi-cylindrical head member 30 may be utilized in lieu of the first semi-cylindrical head 15 formed with a head cavity 31, including a head top wall 32 spaced from a head bottom wall, with an L-shaped top wall slot 33 spaced from a cavity L-shaped slot 34, wherein the slots 33 and 34 are arranged in a parallel coextensive relationship mounting a positioning bar 38 orthogonally therebetween, with the positioning bar 38 projecting upwardly above the head top wall 32. Positioning bar 38 is orthogonally and fixedly mounted to a support bar 35 that in turn includes a plurality of engaging pins 36 mounted fixedly and orthogonally to the support bar 35, with each pin 36 coaxially aligned with the pin bore 37 that is directed through the abutment flange 17. A plurality of spring members 39 are captured between the support bar 35 and an interior surface of the abutment flange 17 to normally bias the pins in a retractable orientation, in a manner as illustrated in FIG. 5. Upon projection of the pins relative to the flange 17, the pins are arranged to enhance engagement of a foil seal between the first and second head abutment flanges 17 and 18 when the positioning bar 38 is directed forwardly and laterally within the L-shaped slots 33 and 34.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawing and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A container seal removal apparatus, comprising, a first leg plate, including a first leg plate lower distal end and a first leg plate upper distal end, and a second leg plate, including a second leg plate lower distal end and a second leg plate upper distal end, wherein the first leg plate lower distal end and the second leg plate lower distal end are in contiguous securement to one another at a junction, with an axle directed through the junction, with the axle formed of a tubular construction, and the first leg plate upper distal end and the second leg plate upper distal end include respective first and second semi-cylindrical heads mounted thereto for securement of a container seal therebetween, with the first semi-cylindrical head including a first abutment flange tangentially aligned relative to the first semi-cylindrical head, and a second abutment flange tangentially aligned and mounted to the second semi-cylindrical head, the first semi-cylindrical head is defined about a first axis, and the second semi-cylindrical head is defined about a second axis, wherein the first axis is oriented parallel relative to the second axis, the first leg plate and the second leg plate are of equal predetermined length, wherein the first leg plate includes a first leg plate forward edge and a first leg plate rear edge arranged in a parallel relationship, and the second leg plate includes a second leg plate forward edge and a second leg plate rear edge arranged in a parallel relationship, and a first positioning flange orthogonally mounted to the first leg plate at the first leg plate forward edge, and a second positioning flange orthogonally mounted to the second leg plate at the second leg plate forward edge, wherein the first positioning flange and the second positioning flange are arranged parallel relative to one another in a confronting relationship, and a first resilient projection orthogonally mounted to the first leg plate rear edge and a second resilient projection orthogonally mounted to the second leg plate rear edge, and a prying leg pivotally mounted about the axle in contiguous adjacency relative to an interior surface of the first leg plate arranged for positioning between the first positioning flange and the first resilient projection, and a piercing leg arranged in parallel and contiguous adjacency relative to the second leg plate pivotally mounted about the axle arranged for reception between the second positioning flange and the second resilient projection.

2. An apparatus as set forth in claim 1 wherein the prying leg includes a forward pry blade arranged in coplanar relationship relative to the prying leg, and the piercing leg includes a U-shaped bifurcated piercing head at a forward distal end thereof spaced from the axle, including a plurality of spikes defining a cutting edge therebetween of U-shaped configuration.

3. An apparatus as set forth in claim 2 including a magnet member mounted to an exterior surface of the first leg plate for mounting the apparatus to a ferrous support surface.

4. An apparatus as set forth in claim 3 wherein the first semi-cylindrical head includes a head cavity, and further includes a head top wall spaced from a head bottom wall, and an L-shaped top wall slot directed through the top wall arranged in a parallel coextensive relationship relative to a L-shaped slot positioned within the cavity, and a positioning bar slidably mounted between the cavity L-shaped slot and the top wall slot, with the positioning bar projecting above the head top wall, and a support bar fixedly and orthogonally mounted to the positioning bar within the cavity in parallel adjacency relative to the first abutment flange, and the first abutment flange includes a plurality of pin bores directed therethrough spaced apart a predetermined spacing, and the support bar includes a plurality of engaging pins, with each engaging pin coaxially aligned with one of said pin bores, the engaging pins spaced apart the predetermined spacing, and at least one spring member mounted between the support bar and the first abutment flange interior surface to bias the support bar in a spaced relationship relative to the first abutment flange interior surface, whereupon forward projection of the positioning bar within the cavity effects projection of the engaging pins through the pin bores.

* * * * *